US008448556B2

(12) United States Patent
Regebro

(10) Patent No.: US 8,448,556 B2
(45) Date of Patent: May 28, 2013

(54) INNER-BALLISTIC FOR RECOILLESS WEAPON

(75) Inventor: Christer Regebro, Eskilstuna (SE)

(73) Assignee: SAAB AB, Linkoping (SE)

( * ) Notice: Subject to any disclaimer, the term of this patent is extended or adjusted under 35 U.S.C. 154(b) by 97 days.

(21) Appl. No.: 13/201,571

(22) PCT Filed: Feb. 16, 2009

(86) PCT No.: PCT/SE2009/000086

§ 371 (c)(1),
(2), (4) Date: Aug. 30, 2011

(87) PCT Pub. No.: WO2010/093287

PCT Pub. Date: Aug. 19, 2010

(65) Prior Publication Data

US 2011/0296977 A1 Dec. 8, 2011

(51) Int. Cl.
*F41A 1/08* (2006.01)
*F41A 1/10* (2006.01)

(52) U.S. Cl.
USPC ..... 89/1.701

(58) Field of Classification Search
CPC ..... F41A 1/08; F41A 1/10
USPC ..... 89/1.7, 1.701, 1.702, 1.703, 1.704, 89/1.705, 1.706; 42/1.06
See application file for complete search history.

(56) References Cited

U.S. PATENT DOCUMENTS

| | | | | |
|---|---|---|---|---|
| 2,887,013 | A * | 5/1959 | Marsh | 89/193 |
| 4,126,077 | A * | 11/1978 | Quesnel | 89/1.704 |
| 5,515,767 | A * | 5/1996 | Gilbert | 89/1.701 |
| 7,350,449 | B2 * | 4/2008 | Franzen et al. | 89/1.701 |
| 2005/0115392 | A1 * | 6/2005 | Franzen et al. | 89/1.701 |

FOREIGN PATENT DOCUMENTS

| | | |
|---|---|---|
| GB | 776019 | 5/1957 |
| GB | 915196 | 1/1963 |
| JP | 06-66496 | 3/1994 |
| WO | WO-95/14207 | 5/1995 |

* cited by examiner

*Primary Examiner* — Gabriel Klein
(74) *Attorney, Agent, or Firm* — Novak Druce Connolly Bove + Quigg LLP

(57) ABSTRACT

The present invention relates in general to a recoilless weapon (1) and, in particular to a new high- and low pressure system for recoilless weapons (1). The invention provides a recoilless weapon (1) comprising a launch tube (2) open at muzzle (3) and breech (4) ends thereof, a projectile (5) and a counter mass (6) residing in said recoilless weapon (1), the recoilless weapon (1) further comprises a high pressure part (7) containing a propellant charge (8) for propelling the projectile (5) and the counter mass (6) out of the launch system (1), a low pressure part (9) containing the counter mass (6), a blocking element (16) in the rear part of the launch tube (2) and gas-openings (10) between the high pressure part (7) and the low pressure part (9) The invention is characterized in that the projectile (5) is positioned in a first start position, where the projectile (5) is blocking the gas-openings (10) and where the projectile (5), upon ignition of the propellant charge (8), moves to further positions (12') in the launch tube (2), where the gas-openings, successively, are unblocked by the projectile (5).

20 Claims, 3 Drawing Sheets

INNER-BALLISTIC FOR RECOILLESS WEAPON

CROSS REFERENCE TO RELATED APPLICATIONS

This application is a National Phase filing under 35 U.S.C. §371 of PCT/SE2009/000086 filed on Feb. 16, 2009, the entire contents of which is hereby incorporated by reference.

The present invention relates in general to a recoilless weapon and, in particular to a high- and low pressure system for recoilless weapon.

BACKGROUND

A recoilless weapon, typically, comprise a launch tube or barrel, open at muzzle and breech ends thereof, a projectile in the middle part of the launch tube and a counter mass in the rear part of the launch tube. Between the projectile and the counter mass is a propellant disposed, which propellant upon activation, causes the projectile and the counter mass to expel out from the launch tube. Main characteristics are; low recoil-force, low air-pressure and low heat-signature. Low recoil forces and low pressures are of particular importance when a weapon is fired from a gunners shoulder in confined spaces, such as in small rooms or bunkers.

Currently, few recoilless weapons exist, which fulfils requirements for safe use in confined spaces, which weapons are small and compact for easy handling and still acceptable in firing range.

New countermasses have been developed to reduce recoil, pressure and heat-signature. Countermasses comprising liquids for extinguishing of flames, countermasses based on compacted powders for rapid decomposition and segmented countermass adapted to release sequentially.

Much work has also been devoted to the internal ballistics of a counterless weapon. New high- and low pressure systems with improved balance between a projectile and a counter-mass, such that recoil and air pressure are reduced.

WO 03/064956 discloses a counterless weapon with a high- and low pressure system. The high- and low pressure system is arranged in the launch tube behind the projectile. The high-pressure part is constituted by a propellant chamber, partly filled with a propellant, and the low pressure part is constituted by a countermass chamber, partly filled with a countermass, behind the propellant chamber. Between the high pressure part and the low pressure part is gas-openings arranged. The gas openings provide a gas passage between the high pressure part and the low pressure part.

A problem, however, with the high- and low pressure system in WO 03/064956, is that the gas pressure in the low pressure part may increase too fast if the gas passage is large. Fast increase of the gas pressure causes a quick and early expelling of the countermass. Early expelling of the counter mass may have an adverse effect on recoil and pressure, especially, if the propellant is subjected to heat, since heat increase the burning-rate of the propellant. The gas-passage may be restricted by reducing the cross-flow area of the gas openings. On the other hand, if the gas-passage is restricted, the gas-pressure may increases too slow, causing late expelling of the countermass. Late expelling may have an adverse effect on the firing range of the weapon. Too fast or too slow expelling of the counter mass has an adverse effect on the inner-ballistic properties of the weapon.

Accordingly, there is a need for a high- and low pressure system with improved balance between the projectile and the counter-mass such that recoil force and air pressure are kept low, while firing range high still are acceptable.

A further problem, related to the arrangement with a high- and low pressure system in the launch tube, is that the launch tube tends to be long and ungainly.

OBJECT AND CHARACTERISTICS OF THE INVENTION

A first object of the invention is a recoilless weapon with an improved balance between the projectile and the countermass such that recoil force and air pressure are low, while firing range still are acceptable high.

A further object of the invention is a recoilless weapon, which is short and compact.

Said objects and other objects not enumerated here are satisfactorily achieved within the scope of the present independent patent claims. Embodiments of the invention are specified in the dependent patent claims.

The invention has therefore provided a recoilless weapon, comprising a launch tube open at muzzle and breech ends thereof, a projectile and a counter mass residing in said recoilless weapon, the recoilless weapon further comprises a high pressure part containing a propellant charge for propelling the projectile and the counter mass out of the launch tube, a low pressure part containing the counter mass, a blocking element in the breech end and gas-openings between the high- and low pressure parts.

The essential characteristic of the recoilless weapon according to the invention is that the projectile, is positioned in a first start position in the launch tube, in which first start position the projectile is blocking the gas-openings and that the projectile, upon ignition of the propellant charge, moves forward in the launch tube to further positions, where the gas-openings, successively, are unblocked by the projectile.

According to further aspects of the recoilless weapon according to the invention:

- the high pressure part, containing the propellant charge, is arranged in the launch tube behind the projectile and the low pressure part containing the counter mass, is arranged outside the launch tube,
- the low pressure part is arranged in a gas tube, coaxially to the launch tube,
- the gas openings are arranged as through holes in the launch tube wall, which through holes are arranged around the launch tube, in at least one concentric circle,
- the cross-sections of the through holes are oval-shaped,
- the through holes are angled 45 degree in backward direction relative to the centre B-B of the recoilless weapon,
- the projectile has an inclined part for, successively, unblocking the gas-openings, as the projectile moves to forward positions in the launch tube,

ADVANTAGES AND EFFECTS OF THE INVENTION

The invention proposed above affords several advantages.

A counter-less weapon is provided where forces of the projectile and the counter mass are balanced with corresponding pressurized surfaces, inversely proportional to respective gas pressure A short and compact weapon due to the arrangement of a low pressure part outside the launch tube, coaxial to the launch tube, An improved and repetitive control of gas flows from the high pressure part to the low pressure part regulated by the projectile in the launch tube, A self regulated system in regard to temperature variations in burning-rate of the propellant.

A self regulated system in regard to variations in release strength of the projectile girdle.

Reduced recoil forces due to arrangement with an internal expansion nozzle coupled to the low pressure part.

Further advantages and effects will emerge from a study and consideration of the following detailed description of the invention, including a number of advantageous embodiments thereof, and the figures of the drawings attached. The device according to the invention has been defined in the following patent claims.

DESCRIPTION OF THE DRAWINGS

The invention will be described in more detail below with reference to the drawings attached, in which.

DETAILED DESCRIPTION OF THE INVENTION

Figure 1:
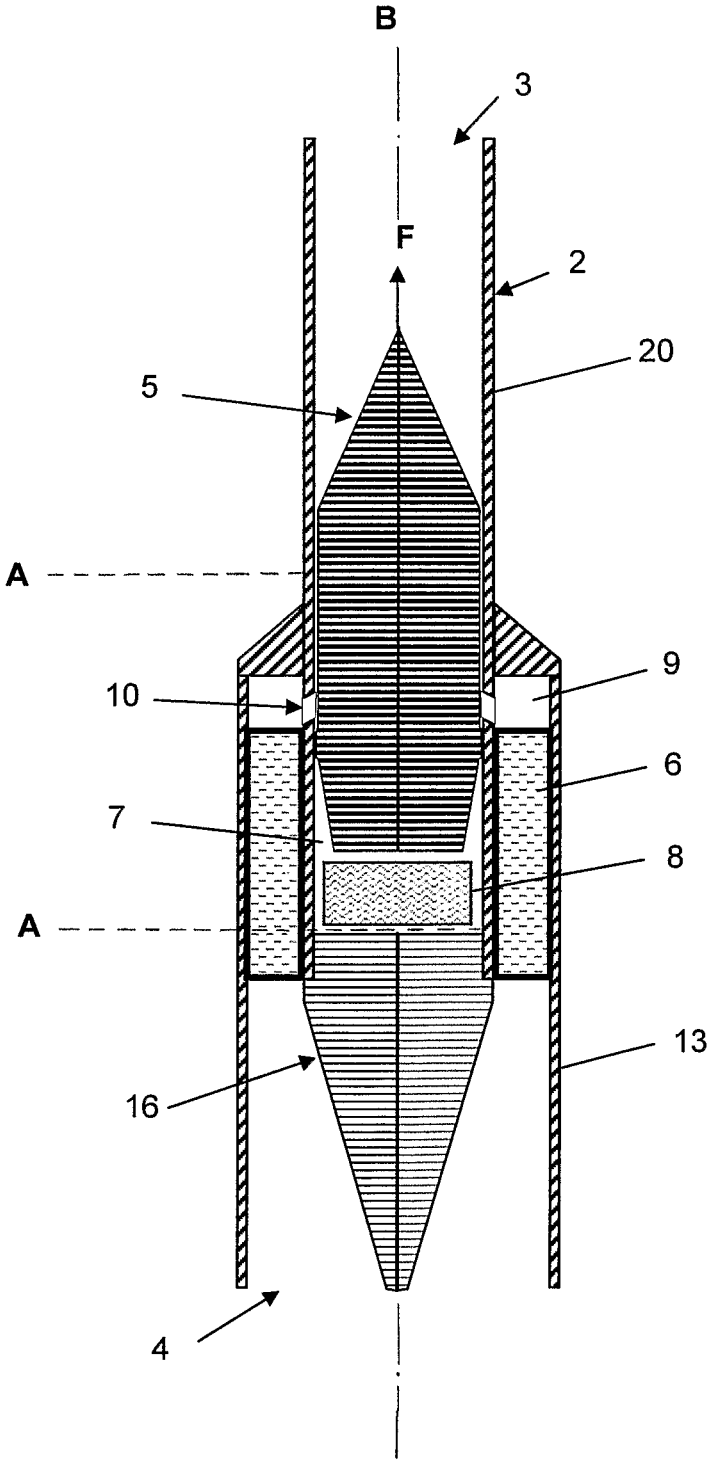
FIG. 1 schematically shows a longitudinal section of a recoilless weapon.
Figure 2:
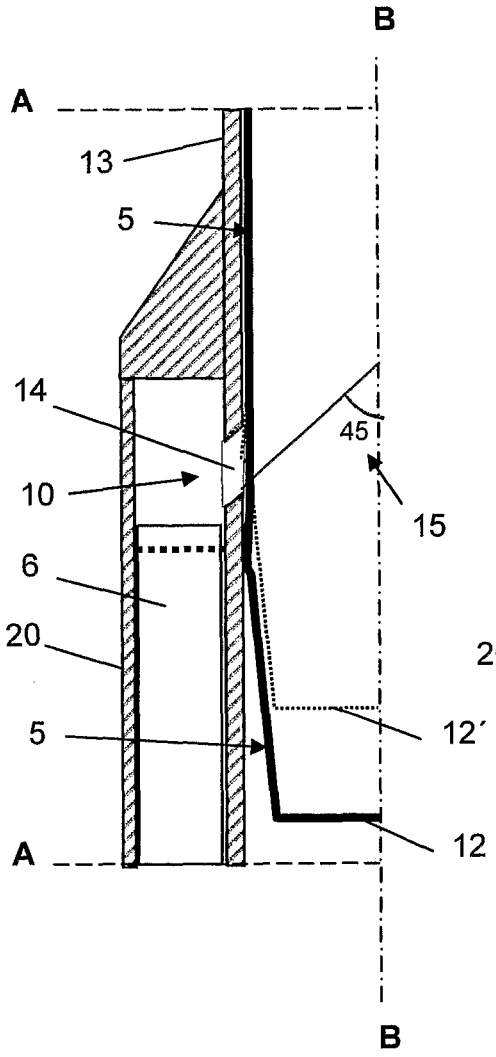
FIG. 2 schematically shows a detailed view of gas openings in FIG. 1 and the projectile at two blocking positions.
Figure 3:
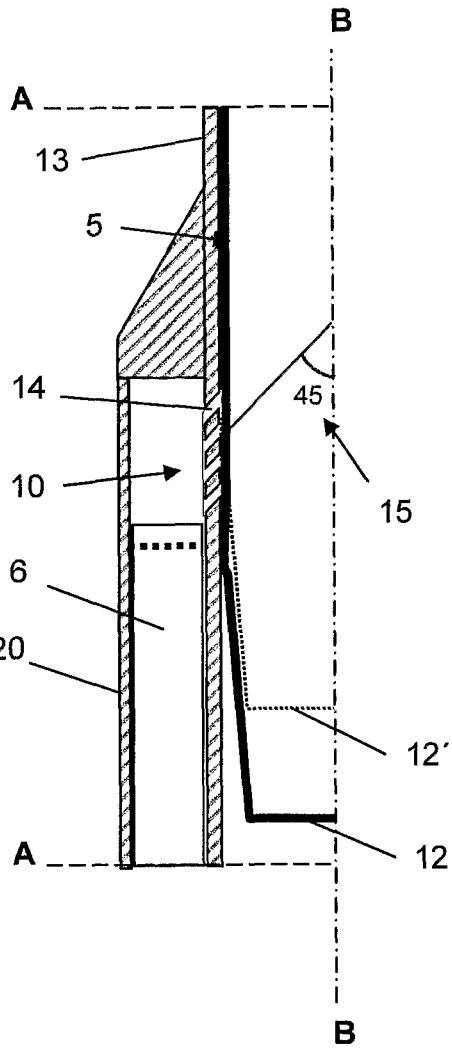
FIG. 3 schematically shows a detailed view of an alternative embodiment of gas openings in FIG. 2.

Referring now to the drawings, particularly to FIG. 1, a cross-sectional longitudinal view of a preferred embodiment of a high- and low pressure recoilless weapon 1 is shown. The recoilless weapon 1 is preferably a hand-held recoilless weapon 1, but may as well be a free-standing recoilless weapon 1.

The recoilless weapon 1 in FIG. 1 comprises a launch tube 2 open at muzzle 3 and breech 4 ends thereof, a projectile 5, a counter mass 6 and a gas generating device. The gas generating device, preferably a propellant charge 8, which propellant 8, upon ignition, expels the projectile 5 and the counter mass 6 out of the launch tube 2. The propellant charge 8 is arranged in the launch tube 2, behind the projectile 5 in front of a blocking element 16. The blocking element 16 is preferably cone-shaped, and arranged such that the conical part of the element 16 is pointing backwards relative to the launch direction F of the projectile 5.

The propellant charge 8 is arranged in the space 7 between the rear part of the projectile 5 and the blocking element 16 which constitute the high pressure part 7 of the weapon 1.

The counter mass 6 is arranged outside the launch tube in a countermass container 13. The countermass container 13 is, preferably, a cylindrical gas tube 13, arranged coaxial to the launch tube 2. The forward end of the countermass tube 13 is closed and readily fixed to the launch tube 2. The rear end of the gas tube 13 is open and extends backwards parallel to the launch tube 2. The countermass tube 13 may in alternative embodiments have other cross-shapes than circular; such as oval or triangular.

The countermass 6 is arranged in the countermass tube 13, at a defined distance from the forward end of the countermass 6. The space between the countermass 6 and the closed forward end of the countermass tube 13 constitute the low pressure part 9 of the weapon 1. Between the high pressure part 7 and the low pressure part 9 is several gas-openings 10 arranged, see cut A-A of FIG. 1 in FIGS. 2 to 5. The gas openings 10, are arranged as radial through-holes 14 in the launch tube wall 20, and, preferably, cylindrical shaped. The cross flow sections are circular, but may be triangular, or oval. Furthermore, the through holes 14 are, preferably, angled 45 degree in backward direction, relative the centre line B-B, such that gas flows from the high pressure part 7 directs backwards and counteract with recoil from the projectile 5.

Figure 4:
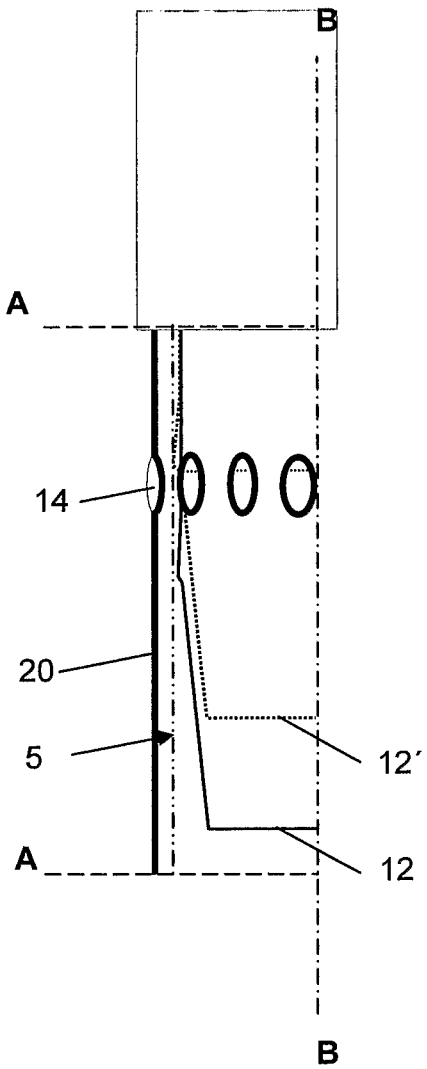
FIG. 4 schematically shows configuration of the gas openings in FIG. 2 around the launch tube.
Figure 5:
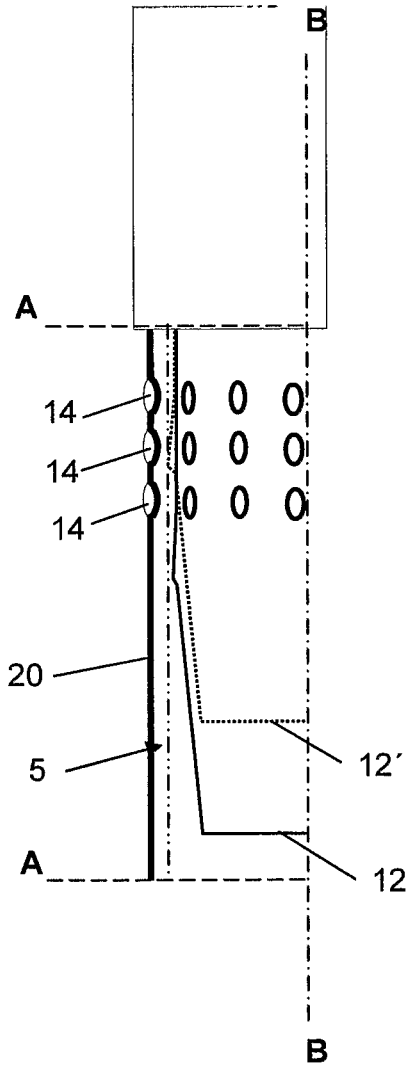
FIG. 5 schematically shows configuration of the gas openings in FIG. 3 around the launch tube.

FIGS. 4 and 5 shows a special arrangement where the through holes 14 are configured in concentric circles around the launch tube, parallel to each other, preferably at equal distances from each-other.

Other configurations of the holes 14 around the launch tube 5 are also possible.

The rear part of the countermass tube 13 extends backwards, parallel with the cone-shaped blocking element 16. The space between the countermass tube 13 and the cone shaped element 13 forms an internal expanding nozzle 30 for expanding gases from the low pressure part 9.

Upon ignition of the propellant 8, the gas-pressure starts to increase in the high-pressure part. At a defined threshold pressure in the high pressure part 7, the projectile 5 is released and starts to move forward F, in the launch tube 2. When the projectile 5 is moving forwardly, the inclined rear part 11 of the projectile 5 passes the gas-openings 10, and the gas passage 10 between the high pressure part 7 and the low pressure part 9, successively, increase. Initially, when the projectile 5 has moved a short distance, the gas flow is restricted and the gas flow is low, but as the projectile 5 continue to move, the gas-flow continue to increase, successively.

Depending on the inclination and the shape of the rear part 11, various gas-flow characteristics are possible. Large inclination, gives a fast increase of the gas-flow, while small inclination gives a slow increase. The inclined part 11 of the projectile 5 may have different shapes, such as planar, concave or convex shapes to further influence gas flow characteristics. As the projectile 5 continue to accelerate, the weapon 1 accelerates backwards, causing backward recoil. After a short time, when the gas pressure in the low pressure part 9 reach a threshold value, the countermass 6 starts to move and accelerate rearward in the weapon 1, causing a forward recoil of the weapon 1. The forward recoil counteract with the backward recoil.

When the countermass 6 leaves the weapon, a sudden gas expansion takes place in the nozzle 30, between the cone 16 and the gas tube 13, causing a sharp increase of the forward recoil of the weapon 1. After the sudden gas expansion, the gas pressure in the low pressure part 7 decreases rapidly, causing a slow-down of the forward recoil.

Furthermore, the gas-flow is partly self-regulated to variations in burning-rate of a propellant 8. The burning-rate depends on the temperature. If the temperature is high, such as a warm summer day, the burning-rate is high, causing the projectile to accelerate faster. This in turn leads to a higher gas flow to the lower pressure part. Correspondingly, if the temperature is low the burning-rate is low, causing a lower gas flow to the low pressure part.

Basically, the function of the countermass 6 is to maintain a proportionately high gas pressure in the countermass chamber 9, to balance the backward recoil from the projectile 5. The balance depends on, the high- and low pressure parts 7,9, the gas passage between the high- and low pressure parts 7,9, the projectile 5 and the countermass 6.

ALTERNATIVE EMBODIMENTS

The invention is not limited to the examples shown but may be modified in various ways without departing from the scope of the patent claims. The embodiment of the recoilless weapon can therefore be modified within the bounds of feasibility, provided that no additional components are added or fitted to the weapon. For example in an alternative embodiment, not shown, the low pressure part containing the countermass may be arranged in the launch tube, behind the projectile and the high pressure part containing the propellant may be arranged outside the launch tube in a chamber, coaxial to the launch tube.

The invention claimed is:

1. A recoilless weapon, comprising; a launch tube open at muzzle and breech ends thereof, a projectile and a counter mass residing in said recoilless weapon, the recoilless weapon further comprises a high pressure part containing a propellant charge for propelling the projectile and the counter mass out of the weapon, a low pressure part containing the counter mass, a blocking element in the breech end and gas-openings between the high pressure part and the low pressure part, wherein the projectile, is positioned in a first start position in the launch tube, in which start position the projectile is blocking the gas-openings and that the projectile, upon ignition of the propellant charge, moves forward to further positions in the launch tube, where the gas-openings, successively, are unblocked by the projectile.

2. A recoilless weapon, according to claim 1, wherein the high pressure part, containing the propellant charge, is arranged in the launch tube behind the projectile and that the low pressure part containing the counter mass is arranged outside the launch tube.

3. A recoilless weapon, according to claim 2, wherein the low pressure part is arranged in a gas tube, coaxially to the launch tube.

4. A recoilless weapon, according to claim 3, wherein the gas openings are arranged as through holes in the launch tube wall, which through holes are arranged around the launch tube in, at least, one concentric circle.

5. A recoilless weapon, according to claim 3, wherein the cross-sections of the through holes are oval-shaped.

6. A recoilless weapon, according to claim 4, wherein the through holes are angled 45 degree in backward direction relative to a longitudinal of the recoilless weapon.

7. A recoilless weapon, according to claim 1, wherein the projectile has an inclined part for, successively, unblocking the gas-openings, as the projectile moves forward in the launch tube to further positions.

8. A recoilless weapon, according to claim 1, wherein the recoilless weapon further comprises an internal nozzle for expanding gases from the low pressure part, which internal nozzle is constituted by the blocking element and the outer gas tube.

9. A recoilless weapon, according to claim 4, wherein the cross-sections of the through holes are oval-shaped.

10. A recoilless weapon, according to claim 3, wherein the through holes are angled 45 degree in backward direction relative to a longitudinal axis of the recoilless weapon.

11. A recoilless weapon, according to claim 5, wherein the through holes are angled 45 degree in backward direction relative to a longitudinal axis of the recoilless weapon.

12. A recoilless weapon, according to claim 2, wherein the projectile has an inclined part for, successively, unblocking the gas-openings, as the projectile moves forward in the launch tube to further positions.

13. A recoilless weapon, according to claim 3, wherein the projectile has an inclined part for, successively, unblocking the gas-openings, as the projectile moves forward in the launch tube to further positions.

14. A recoilless weapon, according to claim 4, wherein the projectile has an inclined part for, successively, unblocking the gas-openings, as the projectile moves forward in the launch tube to further positions.

15. A recoilless weapon, according to claim 5, wherein the projectile has an inclined part for, successively, unblocking the gas-openings, as the projectile moves forward in the launch tube to further positions.

16. A recoilless weapon, according to claim 6, wherein the projectile has an inclined part for, successively, unblocking the gas-openings, as the projectile moves forward in the launch tube to further positions.

17. A recoilless weapon, according to claim 2, wherein the recoilless weapon further comprises an internal nozzle for expanding gases from the low pressure part, which internal nozzle is constituted by the blocking element and the outer gas tube.

18. A recoilless weapon, according to claim 3, wherein the recoilless weapon further comprises an internal nozzle for expanding gases from the low pressure part, which internal nozzle is constituted by the blocking element and the outer gas tube.

19. A recoilless weapon, according to claim 4, wherein the recoilless weapon further comprises an internal nozzle for expanding gases from the low pressure part, which internal nozzle is constituted by the blocking element and the outer gas tube.

20. A recoilless weapon, according to claim 5, wherein the recoilless weapon further comprises an internal nozzle for expanding gases from the low pressure part, which internal nozzle is constituted by the blocking element and the outer gas tube.

* * * * *